US005913271A

United States Patent [19]

Lloyd

[11] Patent Number: 5,913,271

[45] Date of Patent: Jun. 22, 1999

[54] COLLAPSIBLE MASSAGE TABLE

[76] Inventor: John T. Lloyd, 80926 Turkey Run Rd., Creswell, Oreg. 97426

[21] Appl. No.: 08/950,008

[22] Filed: Oct. 14, 1997

Related U.S. Application Data

[63] Continuation-in-part of application No. 08/717,837, Sep. 23, 1996, Pat. No. 5,676,062, and a continuation of application No. PCT/US97/16918, Sep. 23, 1997.

[51] Int. Cl.[6] ..... A47B 3/00

[52] U.S. Cl. ..... 108/132; 108/36

[58] Field of Search ..... 108/128, 36, 132, 108/38

[56] References Cited

U.S. PATENT DOCUMENTS

| | | | |
|---|---|---|---|
| 441,569 | 11/1890 | Ladd | 108/132 |
| 3,359,576 | 12/1967 | Pile . | |
| 4,333,638 | 6/1982 | Gillotti . | |
| 4,658,735 | 4/1987 | Holton | 108/132 |
| 4,833,998 | 5/1989 | Everett et al. . | |
| 4,927,128 | 5/1990 | O'Brian . | |
| 4,943,041 | 7/1990 | Romein . | |
| 5,009,170 | 4/1991 | Spehar . | |
| 5,177,823 | 1/1993 | Riach . | |
| 5,335,676 | 8/1994 | O'Brien . | |
| 5,524,555 | 6/1996 | Fanuzzi . | |

*Primary Examiner*—Peter M. Cuomo
*Assistant Examiner*—Gerald A. Anderson
*Attorney, Agent, or Firm*—Kolisch, Hartwell, Dickinson, McCormack & Heuser

[57] ABSTRACT

A collapsible massage table has two sides, each side being supported by a support structure including two legs. Various cable lines are used to stabilize the legs when the table is open and upright. The cables also function to automate or semi-automate leg, brace and truss extension and/or folding during opening and collapsing processes.

4 Claims, 13 Drawing Sheets

COLLAPSIBLE MASSAGE TABLE

CROSS REFERENCE TO RELATED APPLICATION

This application is a continuation-in-part of Ser. No. 08/717,837 filed Sep. 23, 1996 now U.S. Pat. No. 5,676,062, issued Oct. 14, 1997 of inventor John T. Lloyd entitled COLLAPSIBLE MASSAGE TABLE. This application is also a continuation of PCT Patent Application Ser. No. PCT/US97/16918, filed Sep. 23, 1997 of inventor John T. Lloyd entitled COLLAPSIBLE MASSAGE TABLE.

FIELD OF THE INVENTION

The invention relates to tables, particularly lightweight collapsible massage tables. The invention involves a lightweight support structure for maintaining a collapsible table in an erect or upright position.

BACKGROUND OF THE INVENTION

Many forms of massage require a special type of table. The table must be capable of supporting a person's entire body weight in a horizontal position. The table should be padded on the upper surface, and it should be adjustable to a height which is appropriate for the masseuse or therapist. For many applications, these objectives must be met in a lightweight collapsible table design because it is often desirable to carry the table to different massage locations. It is also helpful to be able to collapse a massage table for compact storage.

Collapsible massage tables have been designed over the years to satisfy these objectives. U.S. Pat. No. 5,009,170 to Spehar discloses a collapsible massage table which employs a diagonal brace for each table leg and a pair of cables connecting the pivot points of the legs to the articulation points of the braces for the purpose of automatically extending the legs when the table is open, and locking the legs in their upright position while the table is being used. However, the Spehar table fails to provide direct support under the central hinge region of the table. Another problem with Spehar's table is that it requires a relatively low potentially interfering horizontal cable line on each side of the table between the brace joints. This cable line may interfere with certain types of massage techniques or therapies where it is necessary to position the therapist's legs partially under the table. Other collapsible table designs such as the one shown in U.S. Pat. No. 4,833,998 to Everett et al., utilize an inverted truss in cooperation with a taut cable to provide support in the central region of the table when the table is erect. However, Everett et al.'s inverted truss arrangement does not provide sufficient support and leg stabilization for some massage applications. Accordingly, there is a need for a lightweight collapsible massage table which has an integrated support structure for automatically opening and maintaining table legs in an upright position while the table is in use as well as providing sturdy upward support in the center region of the table.

SUMMARY OF THE INVENTION

The invention provides a number of collapsible massage table embodiments which employ cable systems to support and stabilize legs in an upright position, each of which can be folded under the table when it is collapsed.

One embodiment of the invention includes a table top formed by two table pieces which are hinged to each other so that when the table is erect the pieces are substantially co-planar and when the table is collapsed the table portions fold together. The table top has two sides. Each side of the table has a medial region located between first and second ends. Each side of the table is supported by a support structure which includes a first leg pivotally attached at point A below the first end of the side. A second leg is pivotally attached at point B below the second end of the side. A first brace connects the first leg to the medial region of the side. The first brace has an articulating joint at point C. A second brace connects the second leg to the medial region of the side. The second brace has an articulating joint at point D. A first cable line runs from point A to point D to point B. A second cable line runs from point A to point C to point B.

A number of embodiments of the invention employ at least one truss member which extends down from the medial region of the table and impinges on one or more cables, thereby providing upward support in the center (hinged region) of the table while also adding tension to the cable(s) and enhancing the overall support system.

Numerous other variations of the present invention are illustrated and described. For example, table designs in which the legs are slanted outward relative to the table top are supported by cable systems without the assistance of diagonal braces. A number of modified diagonal braces are used in other designs such as rigid non-folding braces, telescoping braces, both internal and external braces, etc. A number of alternative table designs are disclosed in which the legs are connected to the table top frame through slots. A number of cable paths are employed through various series of sliding and non-sliding connection points.

Figure 9:
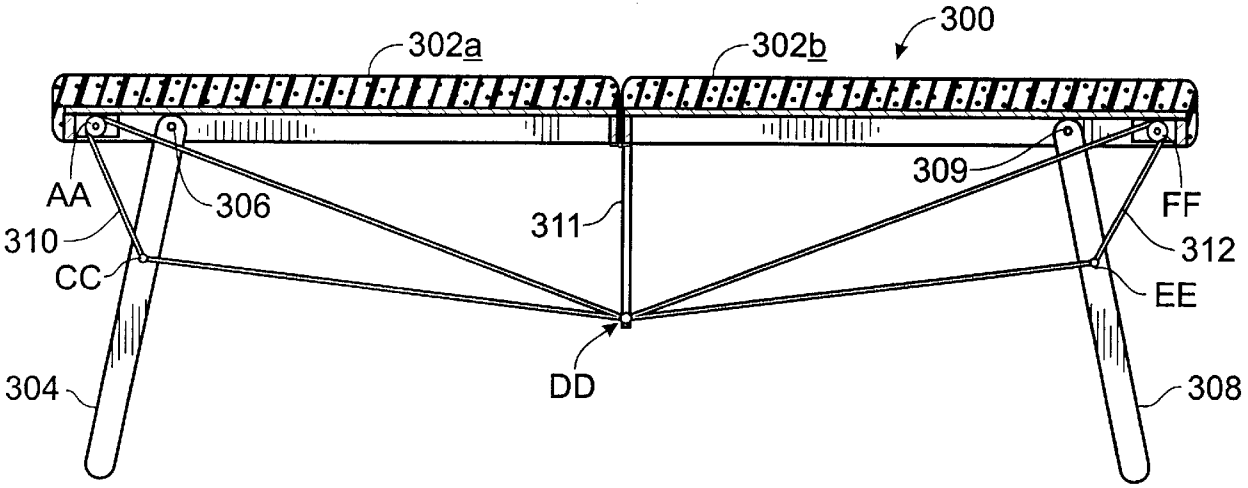
FIG. 9 is a cross-sectional side view of an alternate embodiment of a collapsible massage table of the present invention in which leg braces have been eliminated.
Figure 10:
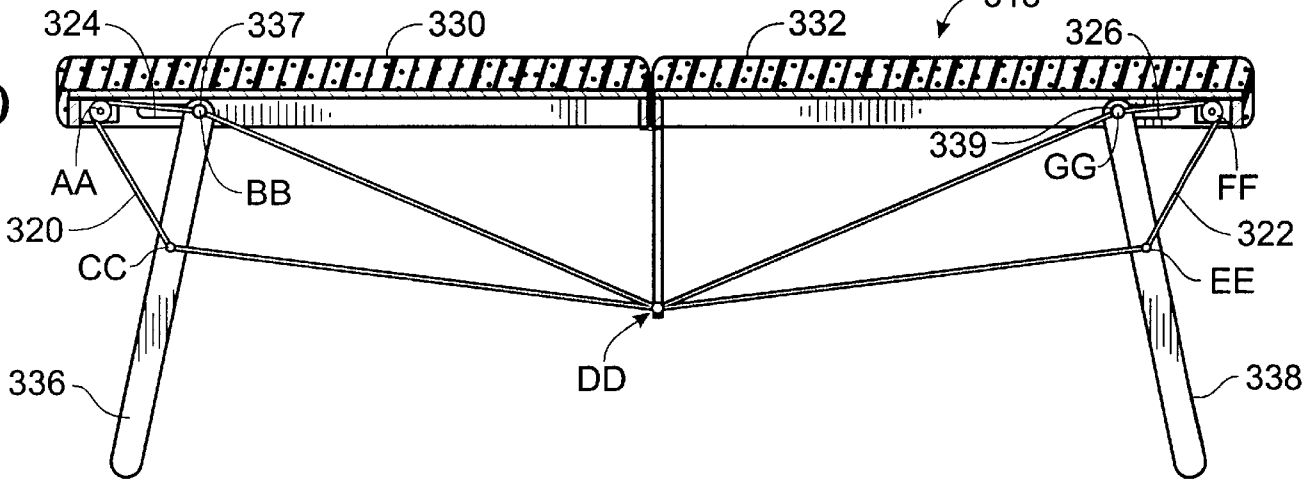
Figure 11:
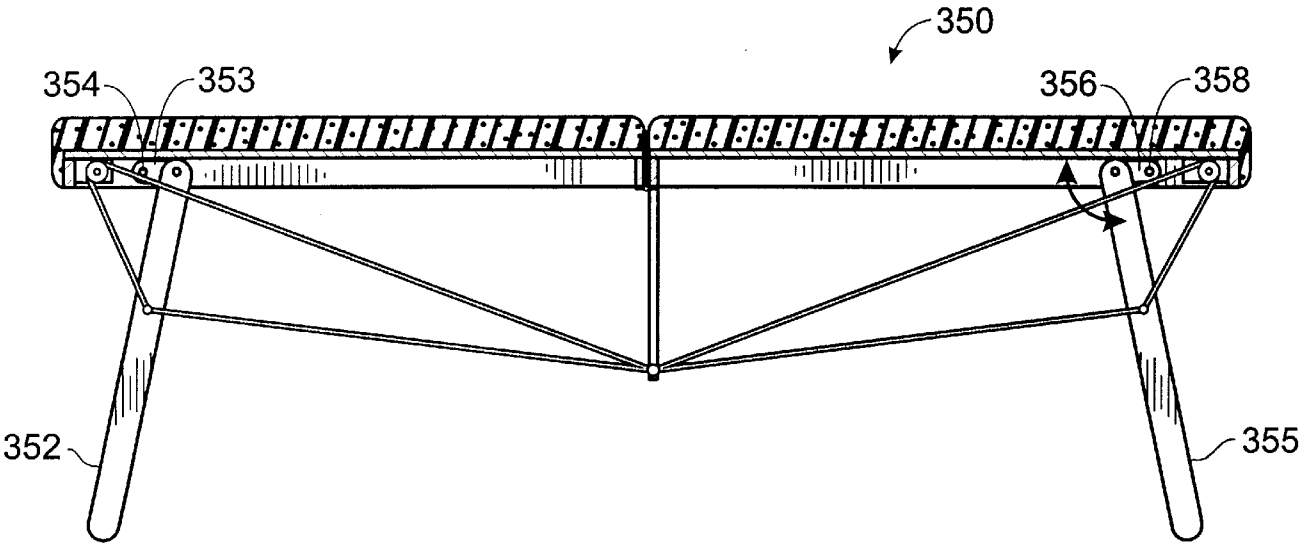

Each of FIGS. 10 and 11 shows modifications of the table shown in FIG. 9.

Figure 12:
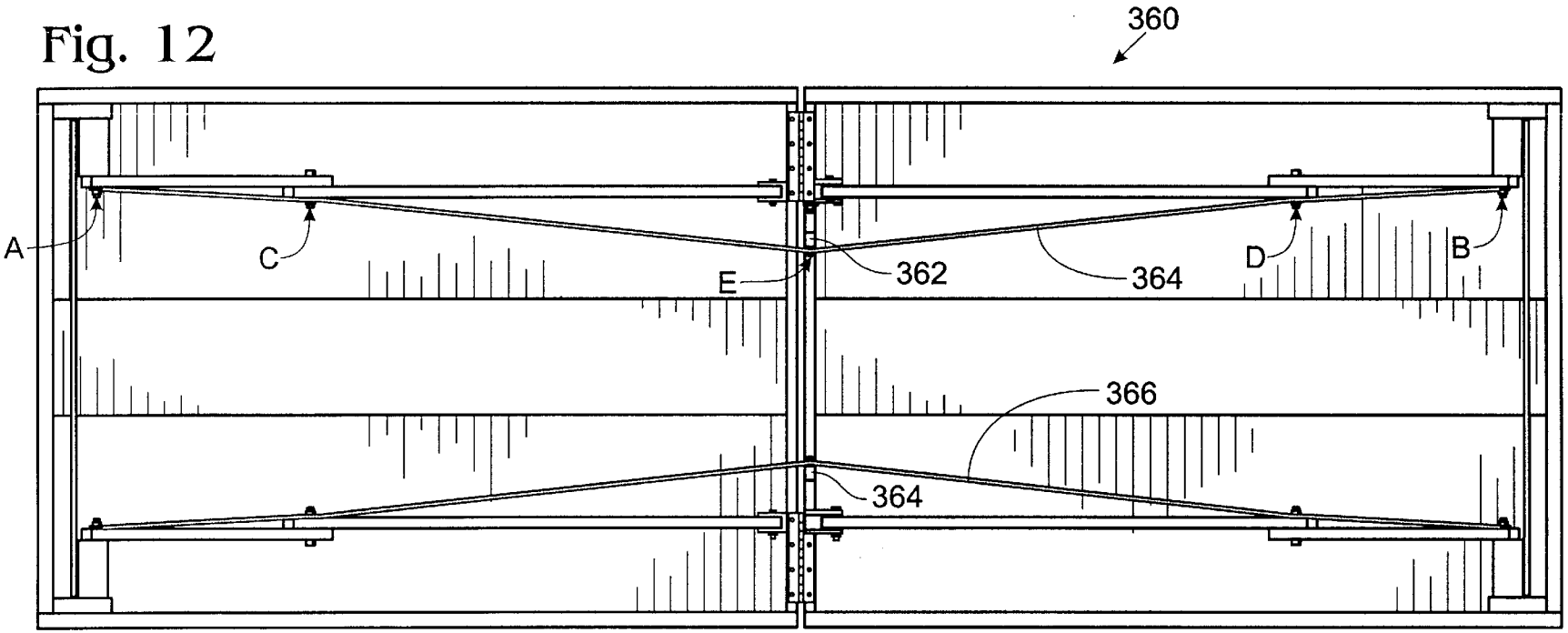

FIG. 12 shows a bottom view of another embodiment in which truss members are relocated toward the center of the table.

FIGS. 13–16 are cross-sectional side views of alternative table embodiments which do not employ rigid braces to support the legs.

Figure 17:
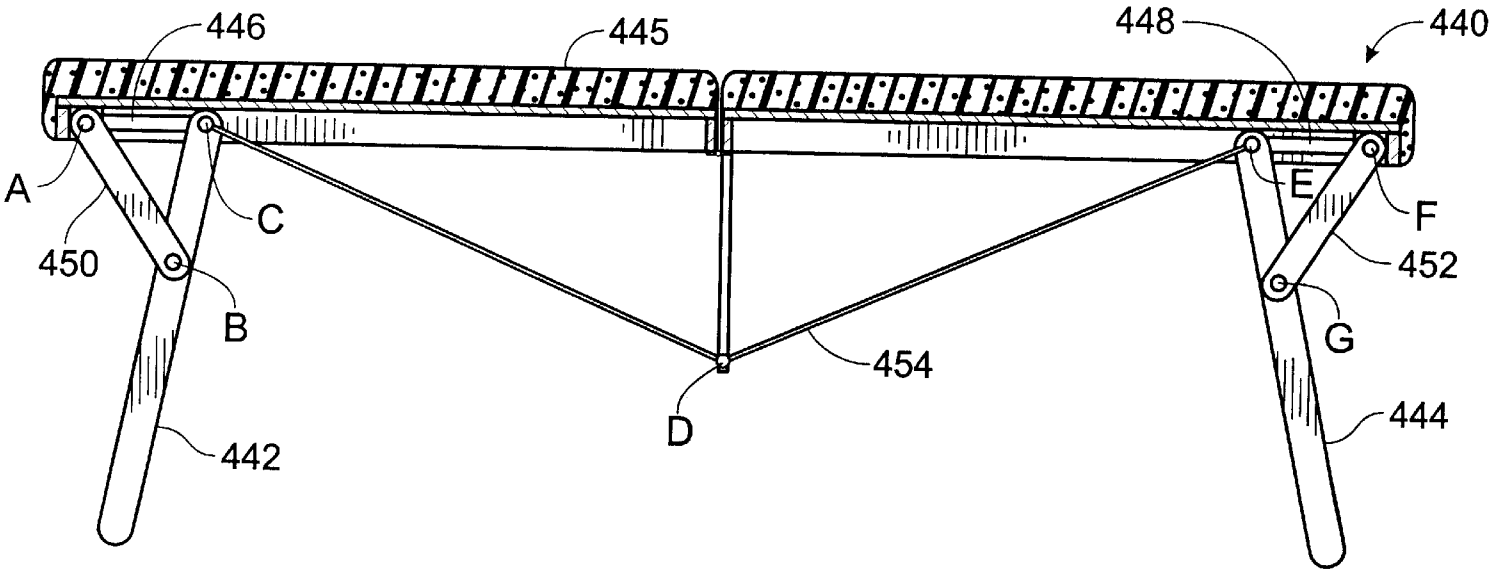

FIG. 17 is a cross-sectional side view of a table which utilizes external diagonal braces to stabilize the legs.

Figure 18:
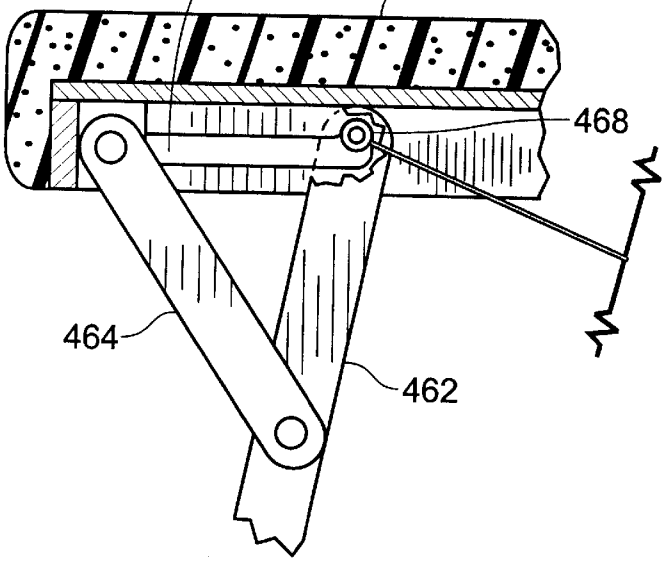

FIG. 18 is a partial side cross-sectional cut-away view of a leg support mechanism for a massage table like the one illustrated in FIG. 17.

Figure 19:
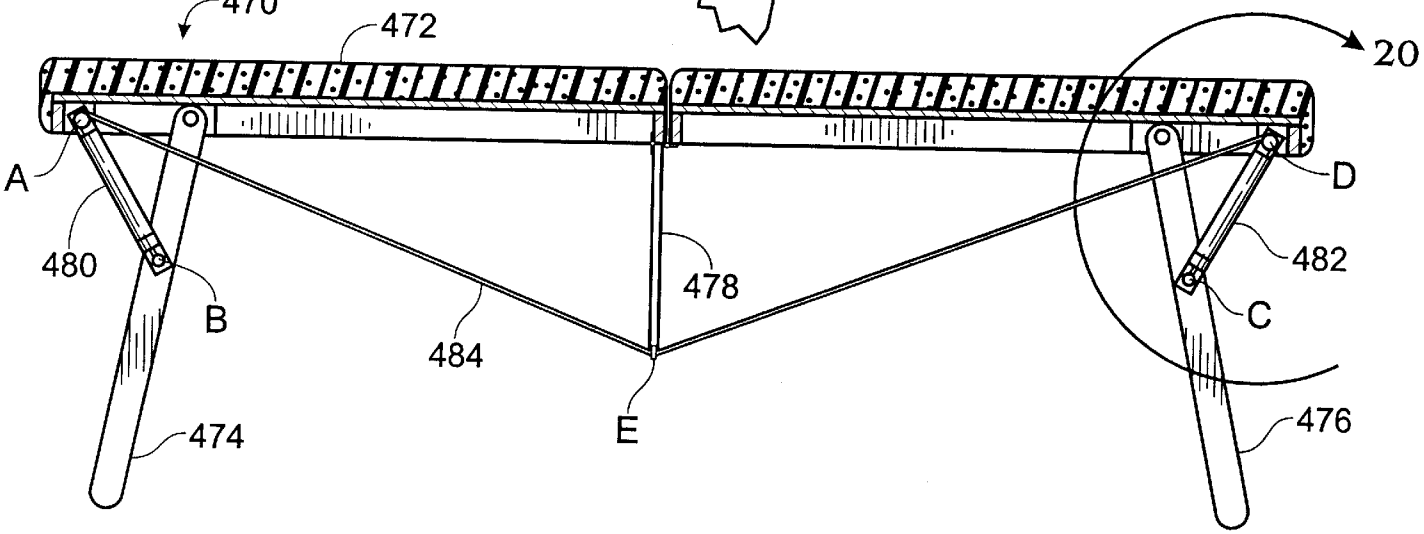

FIG. 19 is a cross-sectional side view of a table employing telescoping diagonal braces.

Figure 20:
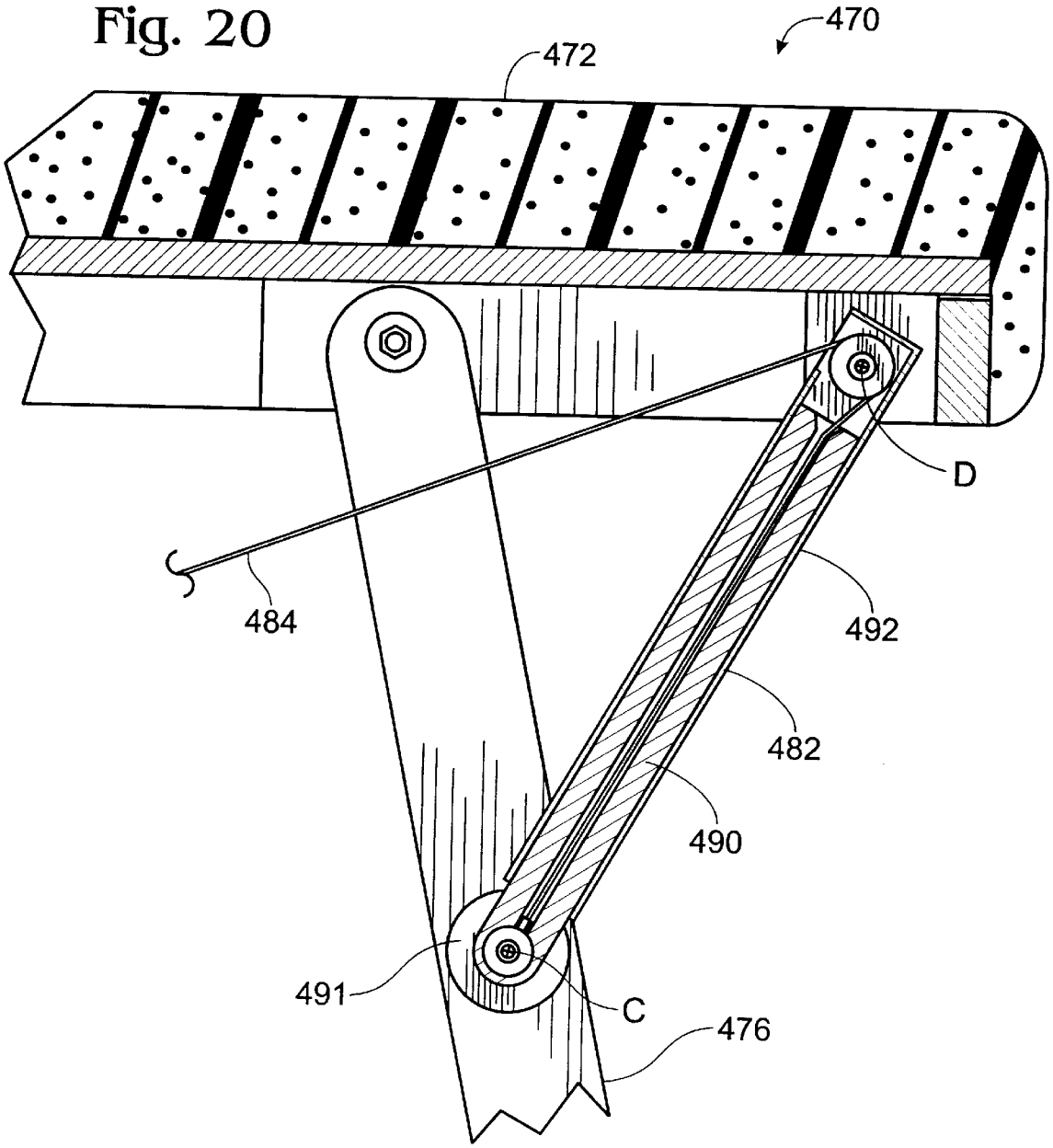

FIG. 20 is a partial cross-sectional view of an end of the table shown in FIG. 19.

Figure 21:
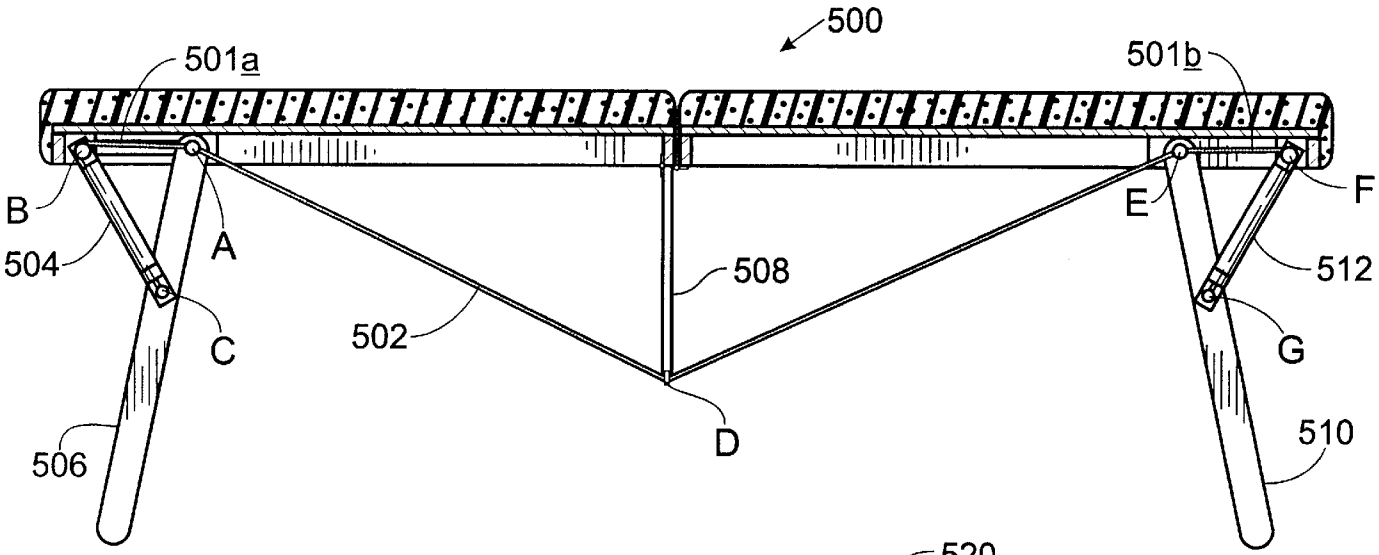

FIG. 21 is a cross-sectional side view of a table which is a modification of the table shown in FIG. 19.

Figure 22:
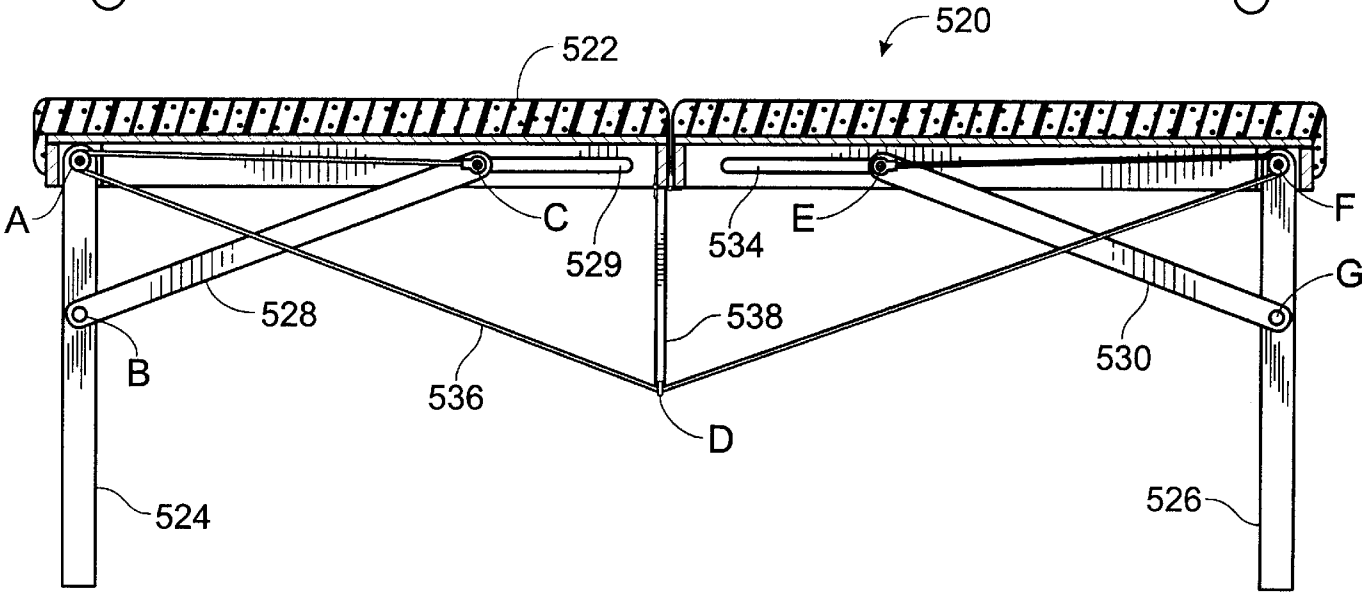

FIG. 22 is a cross-sectional side view of a table employing still another leg, brace and cable support system in accordance with the present invention.

DESCRIPTION OF THE INVENTION

Figure 1:
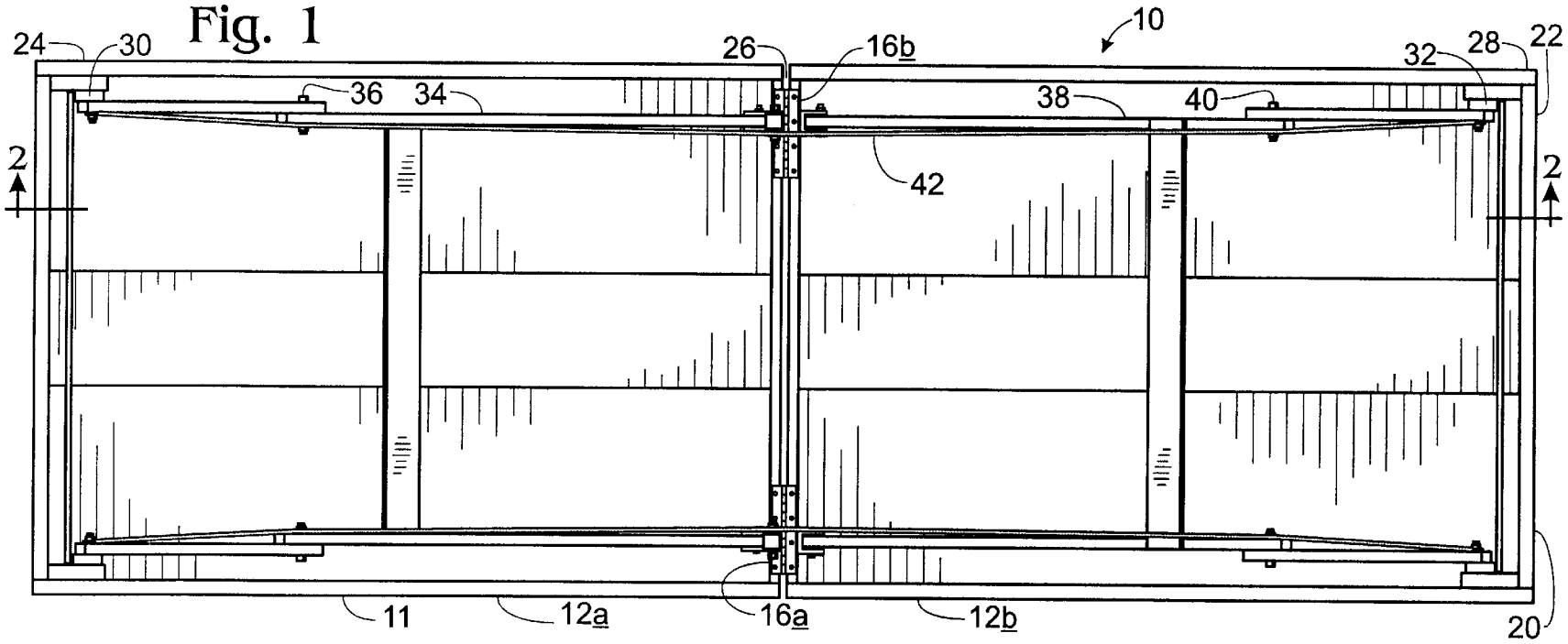
FIG. 1 is an underneath plan view of a table in accordance with the present invention.
Figure 3:
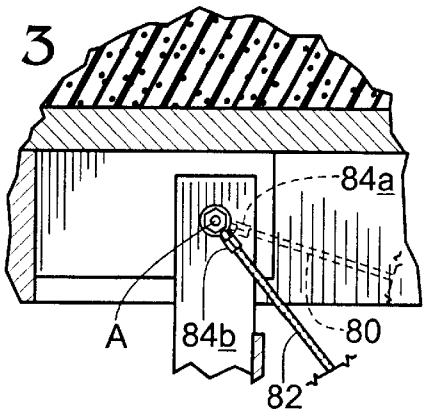
FIG. 3 is a partial enlarged view of a portion of the table shown in FIG. 2.

A collapsible massage table 10 is shown in FIG. 1. Table top 11 is made of two table pieces 12*a* and 12*b*, which are attached to each other by hinges 16*a* and 16*b*. Table 10 has two sides 20 and 22. Support structure associated with side 22 will be described and illustrated in more detail below. Unless otherwise indicated, it may be assumed that the support structure under table side 20 is the same as the structure described for table side 22. Table side 22 has first end 24, medial region 26, and second end 28. First leg 30 is pivotally attached below first end 24 of table side 22. Second leg 32 is pivotally attached below end 28 of table side 22. First brace 34 has an articulating joint 36, and connects a point on leg 30 to the medial region 26 of table side 22. Second brace 38 has an articulating joint 40, and connects a point on leg 32 to medial region 26 of table side 22.

Figure 2:
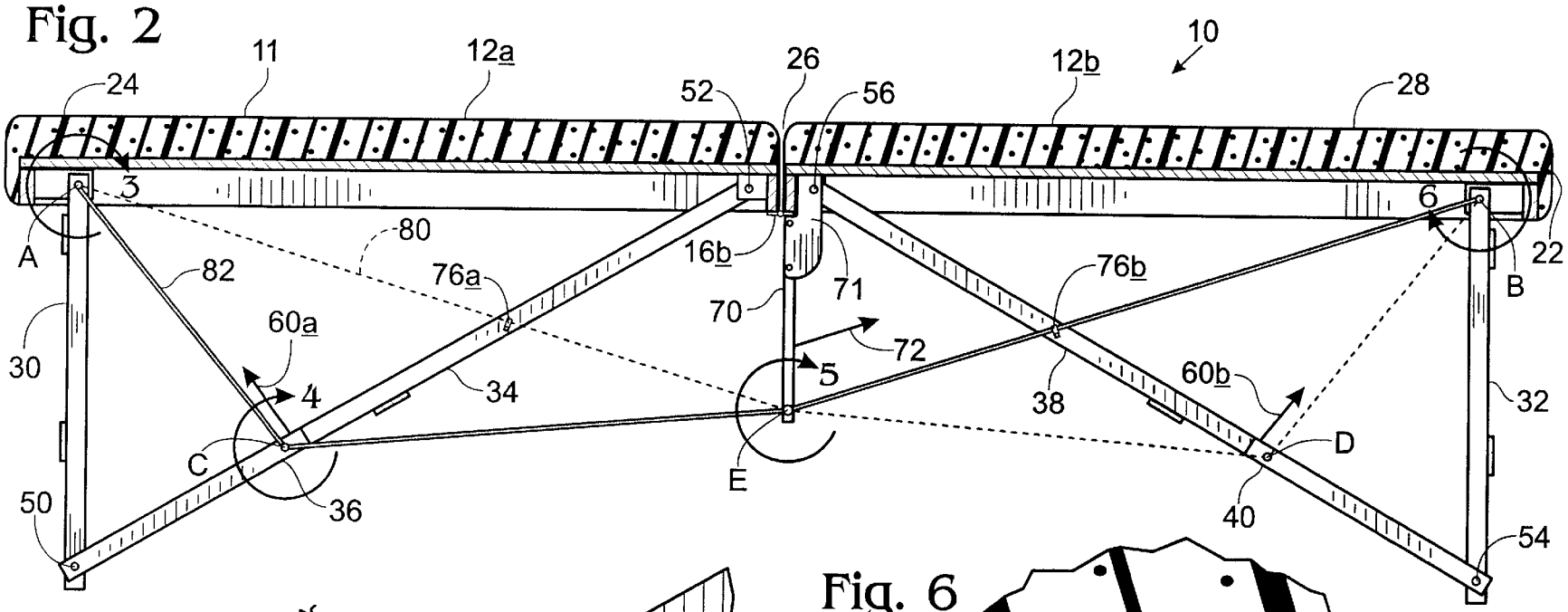
FIG. 2 is a cross-sectional side view of the table shown in FIG. 1.

A cross-sectional view of the table shown in FIG. 1 is illustrated in FIG. 2. Collapsible massage table 10 includes table top 11 in its erect, i.e., open and upright position. Table top 11 has two table pieces 12*a* and 12*b* connected by hinges 16*a* (not shown) and 16*b*. Table side 22 has first end 24, medial region 26 and second end 28. First leg 30 is pivotally attached at point A below end 24 of table side 22. Second leg 32 is pivotally attached at point B below end 28 of table side 22. First brace 34 connects point 50 on leg 30 to point 52 in medial region 26 of side 22. First brace 34 has an articulating joint or hinge mechanism 36 at point C. Second brace 38 connects point 54 on leg 32 to point 56 in the medial region of table side 22. Brace 38 has an articulating joint or hinge mechanism 40 at point D. Arrows 60*a* and 60*b* indicate the directions toward which braces 34 and 38, respectively, fold when the table is collapsed.

Truss member 70 is pivotally attached via bracket 71 to medial region 26 under table piece 12*b*. Arrow 72 indicates the direction toward which truss member 70 folds when table 10 is collapsed. Bracket 71 is dimensioned to fold around the sides of brace 38 allowing truss member 70 to fold against the brace when the table legs are collapsed.

Legs 30 and 32 are opened and maintained in their open positions by cable lines 80 and 82. Each of cable lines 80 and 82 may be a single cable connecting points A and B or plural discreet cables connected at common points along the line. Cable line 80 runs from point A to point D to point B. Cable line 80 functions to prevent brace 38 from pivoting or folding toward it's collapsed position in the direction of arrow 60*b*. Similarly, cable line 82 runs from point A to point C to point B. Cable line 82 prevents brace 34 from pivoting or folding toward it's collapsed position in the direction of arrow 60*a*, thereby locking the table in its open position when it is being used. Cable lines 80 and 82 also function as a foundation for truss member 70. Each of cable lines 80 and 82 are attached at point E to truss member 70. The tension of cable lines 80 and 82 are set up in conjunction with the dimension, i.e. length, of truss member 70 so that truss member 70 cooperatively places tension on cable lines 80 and 82 for leg locking purposes while also providing upward support strength in the medial region of the table on side 22.

As shown in FIG. 2, cable lines 80 and 82 connect to truss member 70 at common point E which, for cable line 80 is between points A and D, and for cable line 82, is between points C and B.

Cable line 80 is also attached to brace 34 by bracket 76*a* at a point of natural intersection with brace 34. Similarly, cable line 82 is attached to brace 38 by bracket 76*b* at a point of natural intersection with brace 38.

Figure 2A:
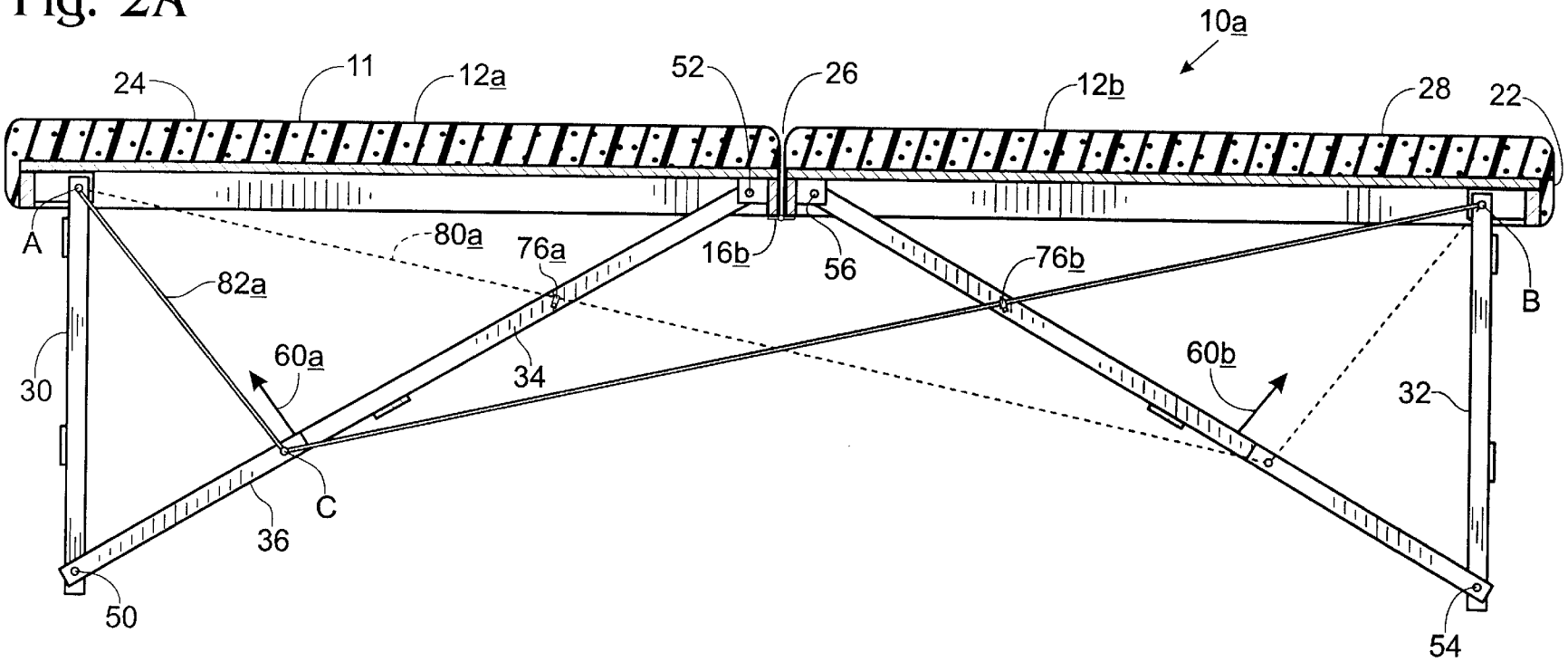
FIG. 2A is a cross-sectional side view of a modified table of the present invention.

The table shown in FIG. 2A is the same as the one shown in FIG. 2 except truss member 70 has been eliminated. The same numbers are used in 2A as were used in FIG. 2 for structures which are the same. Cable lines 80*a* and 82*a* are slightly shorter than their counterparts in FIG. 2 because their path is shorter due to elimination of truss member 70.

It can be appreciated from FIGS. 2 and 2A that cable lines 80 and 82 from FIG. 2 and 80*a* and 82*a* from FIG. 2A are higher and therefore more out of the way in the center region of the table compared to prior cable support systems in which a direct cable line connects the brace joints on each side of the table.

FIGS. 3–6 show preferred mechanisms for attaching cable lines at points indicated in FIGS. 2 and 2A. The portion of table 10 indicated by circular arrow 3 in FIG. 2 is blown up in FIG. 3. Ends of cable lines 80 and 82 have eyelets 84*a* and 84*b* connected to common point A at or near the point where leg 30 is pivotally connected under end 24 of table side 22.

Figure 4:
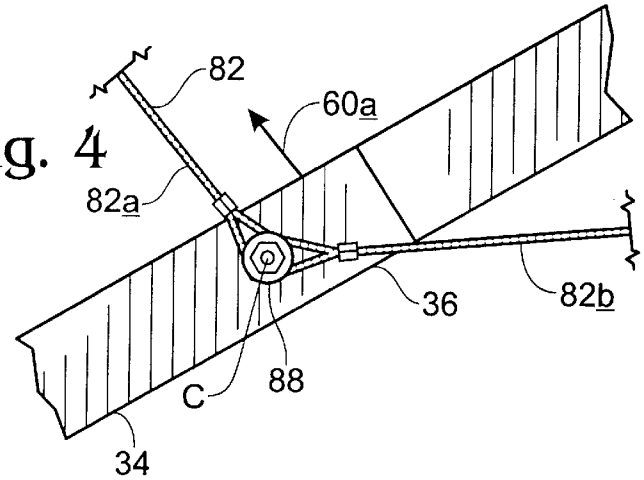
FIG. 4 is a partial enlarged view of a portion of the table shown in FIG. 2.

FIG. 4 shows a blown up view of the portion of FIG. 1 indicated by circular arrow 4 in the region of articulating joint 36 of brace 34. As shown in FIG. 4, cable line 82 includes discreet cable pieces 82*a* and 82*b* which are connected around spool 88 at point C.

Figure 5A:
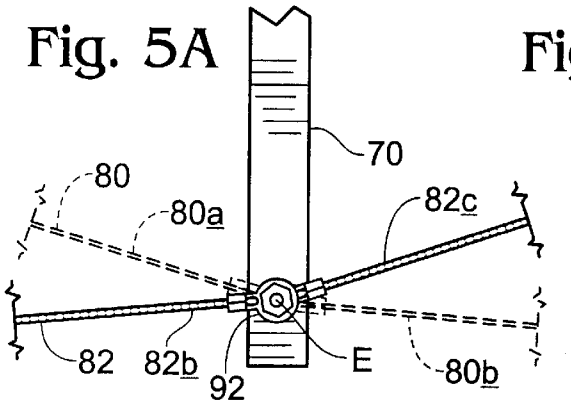
FIGS. 5 and 5A are partial enlarged views of alternative attachment mechanisms for a portion of the table shown in FIG. 2.
Figure 5:
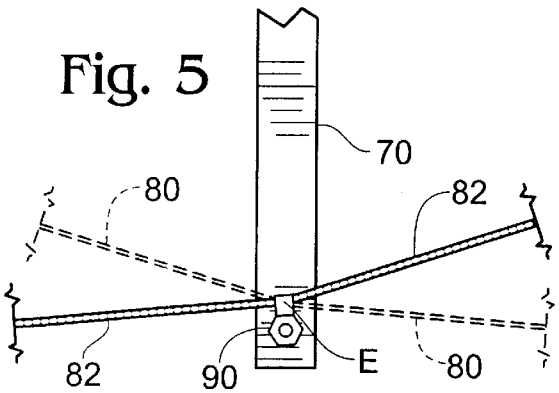

FIGS. 5 and 5A show alternative connection mechanisms for use with truss member 70 at the location indicated by circular arrow 5 in FIG. 2. In FIG. 5 a clamp or fitting such as a tube clamp, P-clamp, etc. is used at point E to connect continuous portions of cable lines 80 and 82 to a side of truss member 70. Alternatively, in FIG. 5A eyelets 92 are used at point E to connect ends of discreet cable pieces 82*b* and 82*c* from cable line 82, and to connect ends of discreet cable pieces 80*a* and 80*b* from cable line 80. Eyelets 92 fit over a bolt which goes through the truss member. Eyelets 92 are locked in position on the side of truss member 70 with a wing nut (not shown). The advantage of this design is that the wing nut can be removed easily allowing detachment of the cables from truss member 70 so that all pieces can be more efficiently and compactly folded within the table pieces when the table is collapsed. The ability to separate and detach cable lines 80 and 82 from truss member 70 also enables the table legs and all support structure to be collapsed and completely contained under the table while the table pieces remain open. This option is important for certain types of massage such as Shiatsu where it is desirable to place the table on the floor without table leg supports.

Figure 6:
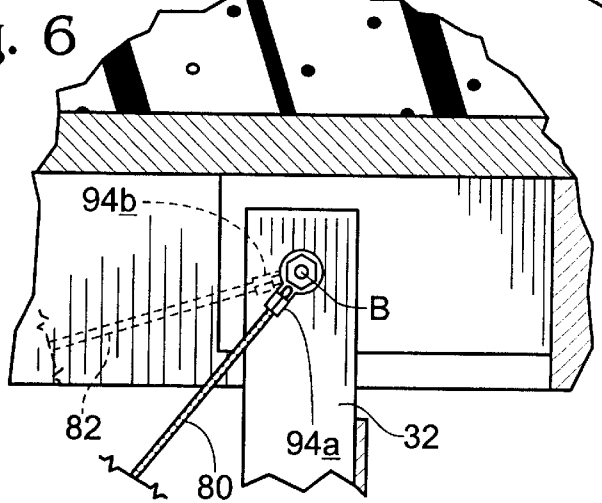
FIG. 6 is a partial enlarged view of the table shown in FIG. 2.

FIG. 6 is a blown up view of the table portion indicated by circular arrow 6 in FIG. 2. Similar to FIG. 3, it shows ends of cable lines 80 and 82 fitted with eyelets 94*a* and 94*b* respectively, connected to point B at or near the point where leg 32 is pivotally connected to end 28 of table side 22.

Figure 7:
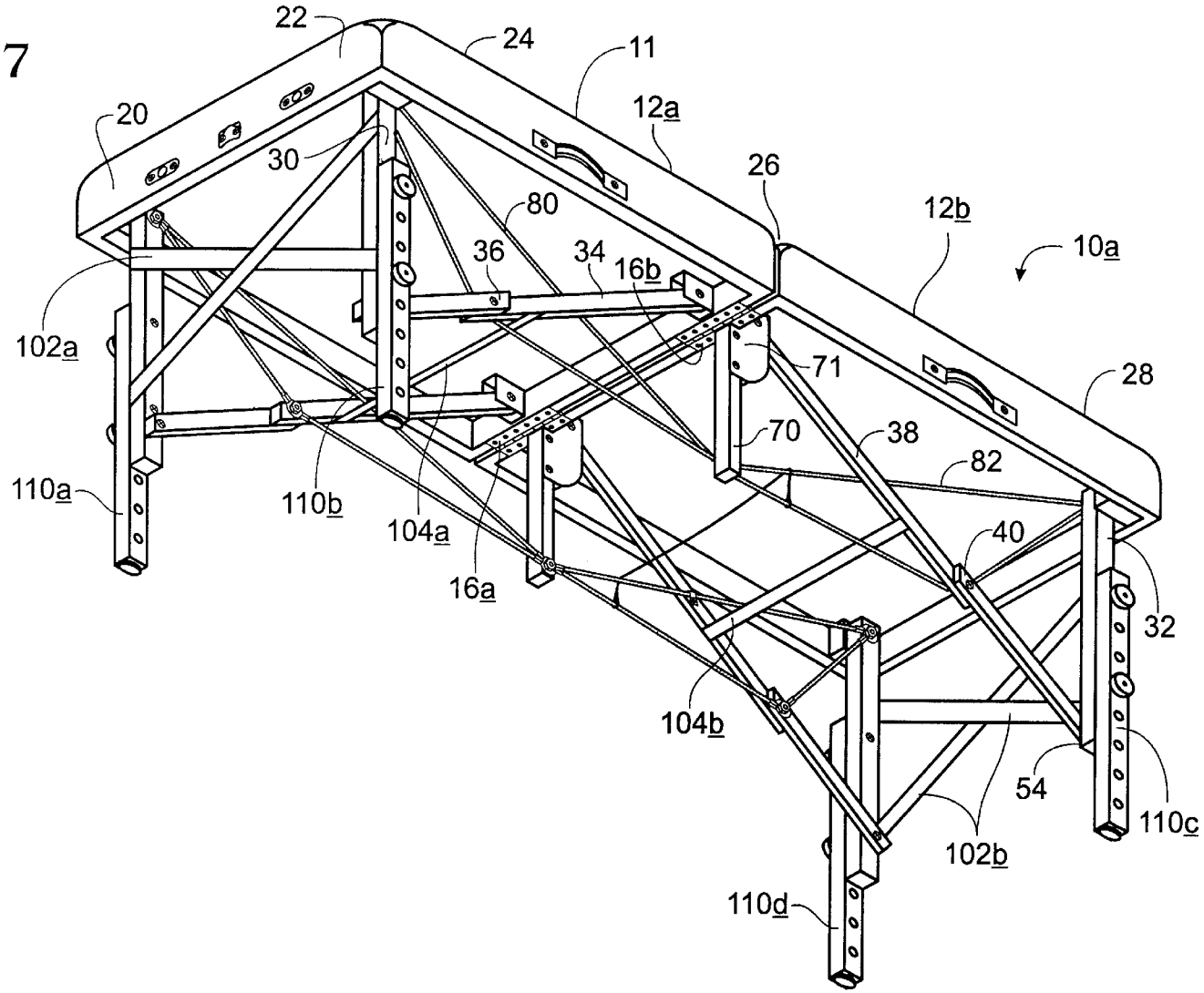
FIG. 7 is an underneath perspective view of the table shown in FIGS. 1 and 2.

FIG. 7 shows a table very similar to the one shown in FIGS. 1 and 2, from a bottom perspective view. Elements of table 10*a* in FIG. 7 which are the same as elements of table 10 in FIGS. 1 and 2, have the same numbers. It can be seen in FIG. 7 that the support system under side 22 of table top 11 is essentially the same as the support system under side 20. The support system under side 22 has already been described in detail with respect to FIGS. 1 and 2. Additionally, FIG. 7 shows cross braces 102*a* and 102*b* connecting and stabilizing respective leg pairs on opposing ends of table 10*a*. Similarly, cross brace 104*a* connects brace 34 to the corresponding brace under side 20 of table top 11, and cross brace 104*b* connects brace 38 to the corresponding brace under side 20 of table top 11.

Table 10*a* also is equipped with leg extension members 110*a*, 110*b*, 110*c*, and 110*d* each of which is variably extendible from its respective table leg for the purpose of adjusting the height of table top 11.

Figure 8:
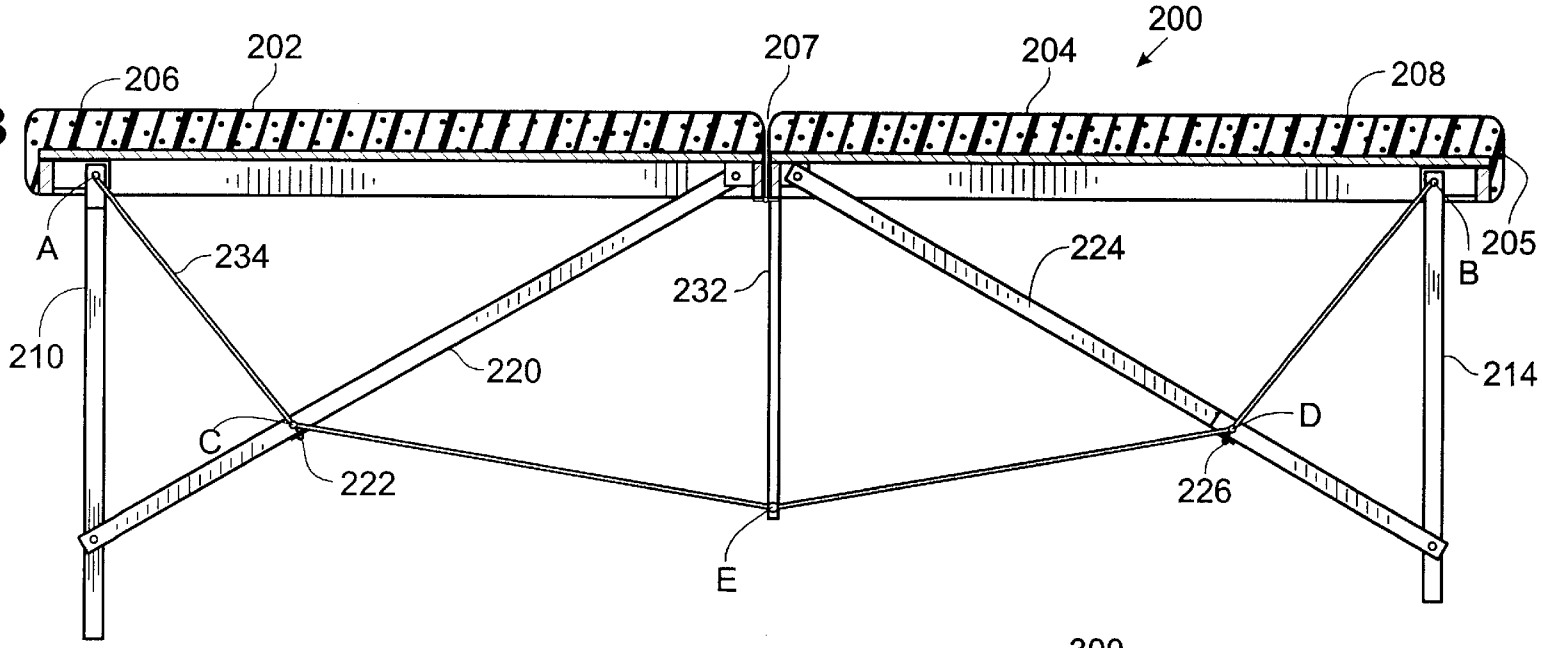
FIG. 8 is a cross-sectional side view of another table of the present invention.

FIG. 8 shows an alternative embodiment of the invention. Collapsible table 200 is formed by two table pieces 202 and 204 which are connected to each other by hinges as described previously. The table top has two sides only one 205 of which is shown in FIG. 8. The support structure used to support the other side of table 200 is the same as the illustrated one. Table side 205 is supported by the support structure shown in FIG. 8. Table side 205 has first end 206, medial region 207 and second end 208. Leg 210 is pivotally attached at point A below end 206. Leg 214 is pivotally attached below end 208 of table side 205. First brace 220 connects first leg 210 to medial region 207 of table side 205. Brace 220 has an articulating joint 222 which folds toward point A when the table is collapsed. Similarly, second brace 224 connects leg 214 to medial region 207 of table side 205. Brace 224 has an articulating joint 226 which folds toward point B when table 200 is collapsed. Truss member 232 extends downward from central region 207 to point E. Cable line 234 runs from point A to point C to point E to point D to point B. The line of cable connection from leg joints through brace joints provides auto-opening and locking functions for the table's support structure, while at the same time providing an upward force on truss member 232, thereby strengthening the medial region of table side 205. A similar support structure including another truss is used on the other side of the table.

FIG. 9–11 show related collapsible massage table designs which are simplified from prior designs because they eliminate the need for braces connecting the table legs to the center region of the table. In FIG. 9 table 300 includes two table pieces 302*a* and 302*b* hinged to each other in the center region of the table. Leg 304 is pivotally attached at point 306 to the underside of table piece 302*a*. Leg 308 is pivotally attached at point 309 to the underside of table piece 302*b*. Cable line 310 connects point CC on leg 304, to and around pulley AA, to point DD at the end of truss 311, and then to point EE on leg 308. Cable line 312 runs from point EE on leg 308, to and around pulley FF to point DD at the end of truss 311, and then to point CC on leg 304. The cable lines may consist of discreet cable pieces or may be one continuous piece. It is also possible for cable lines 310 and 312 to be made of one single cable.

Table 300 is different from the tables previously described in the sense that legs 304 and 308 rotate beyond a perpendicular position with respect to table top pieces 302*a* and 302*b*. This requires pivot points 306 and 309 to be set in from the respective ends of the table. The length of legs 304 and 308 are therefore limited by the requirement that each of the legs must be short enough to fold completely under its respective table top piece.

As shown in FIG. 10, table 318 is quite similar to table 300 of FIG. 9. Cable line 320 runs from point CC, to and around pulley AA, to point BB, to point DD, to point EE. Cable line 322 runs from point EE, to and around pulley FF, to point GG, to point DD, to point CC. Additionally, slots 324 and 326 are provided in the sides of table pieces 330 and 332 respectively. Leg 336 is connected to a support for example, rod 337 which passes through slot 324 and connects in analogous fashion to a corresponding leg on the other side of the table. Leg 338 is connected to support rod 339 which passes through slot 326 and connects to the corresponding leg on the other side. By connecting cable line 320 to point BB, and cable line 322 to point GG, rods 337 and 339 automatically move to the proximal ends of slots 324 and 326 when the table is open. When table 318 is collapsed, each of rods 337 and 339 slide to the distal ends of respective slots 324 and 326. Thus, for a given table size, the design of FIG. 10 permits longer table legs 336 and 338 compared to legs 304 and 308 of table 300.

FIG. 11 shows table 350 which is similar to tables 300 and 318 of FIGS. 9 and 10. However, instead of employing a slot in the side of the table, leg 352 is pivotally attached to link 353 which is pivotally attached at point 354 to the side of the table. Leg 355 is pivotally attached to link 356 which is pivotally attached at point 358 to the side of the table. The cable line paths are the same as those used on table 300. When table 350 is collapsed, links 353 and 356 are rotated toward respective ends of the table so that longer legs may be accommodated within the table pieces when the table is collapsed.

FIG. 12 shows a bottom view of a table support structure like the one illustrated in FIGS. 1 and 2 except truss members 362 and 364 have been relocated toward the center of the table. Cable lines 365 and 366 are attached to sides of respective truss member 362 and 364. Thus, cable lines 365 and 366 are moved from the outside edge of the table toward the center resulting in more leg room for the therapist. A number of other options are suggested by the design of FIG. 12. For example, truss members 362 and 364 could be replaced by a single truss member. Cable lines could also criss-cross in the center of the table suggesting a number of other possible cable support systems.

Figure 13:
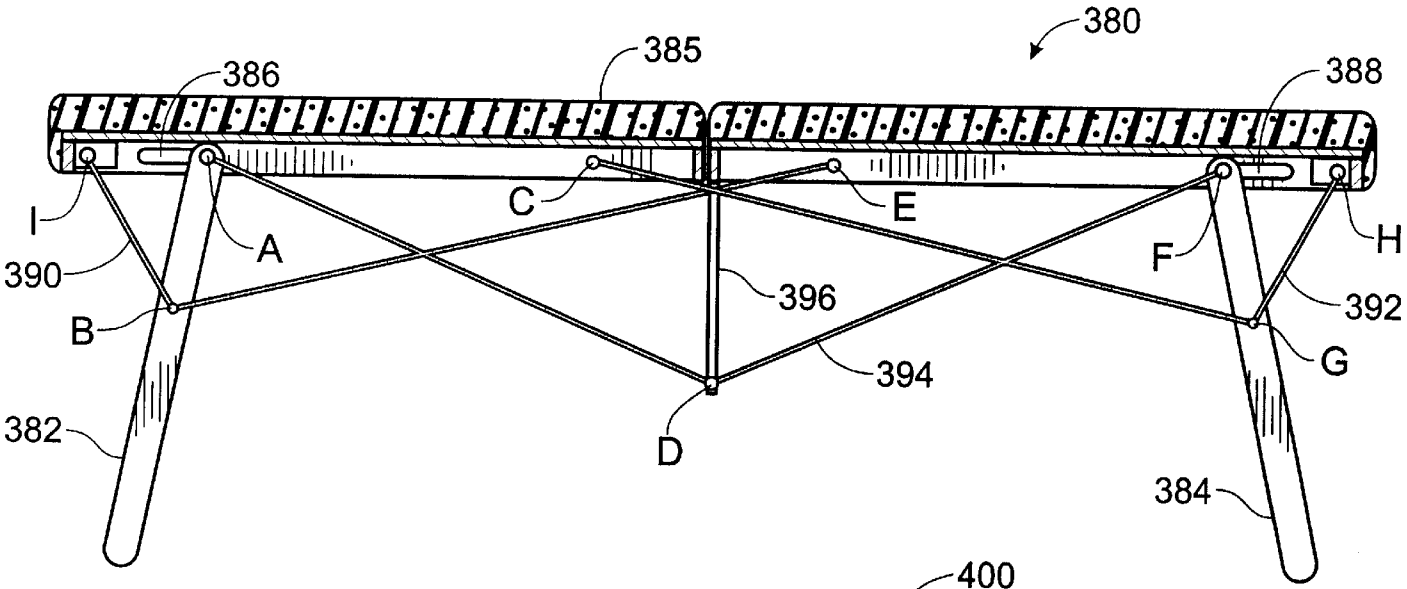

FIG. 13 shows a collapsible massage table design which is similar to the tables shown in FIGS. 9–11 in the sense that no rigid braces are required to connect the legs to the table. On one side of table 380, legs 382 and 384 are connected to the frame of table top 385 through slots 386 and 388, respectively. When table 380 is folded up, the proximal ends of legs 382 and 384 move in their respective slots toward the outer ends of table top 385, thereby allowing use of longer legs than would be possible if pivot points A and F remained stationary. The slanted orientations of legs 382 and 384 are useful in table designs that do not employ any kind of rigid diagonal brace to support the legs. Table 380 has three cable paths supporting and stabilizing each lateral leg pair such as legs 382 and 384. Cable 390 runs from point I to point B to point E. Cable 392 runs from point H to point G to point C. Cable 394 runs from point A to point D, near the distal tip of truss member 396, to point F at the proximal end of leg 384. Cable 394 is fastened to the truss so that it does not slide relative to the attachment point. This feature, which is also employed in the tables illustrated in FIGS. 14–17, 19, 21 and 22, causes the truss to automatically open up when the table is opened. When table 380 is opened up from its collapsed position, legs 382 and 384 and truss member 396 automatically open up into their erect positions as shown in FIG. 13. The legs and truss member must be manually pushed into their folded positions when the table is collapsed.

Figure 14:
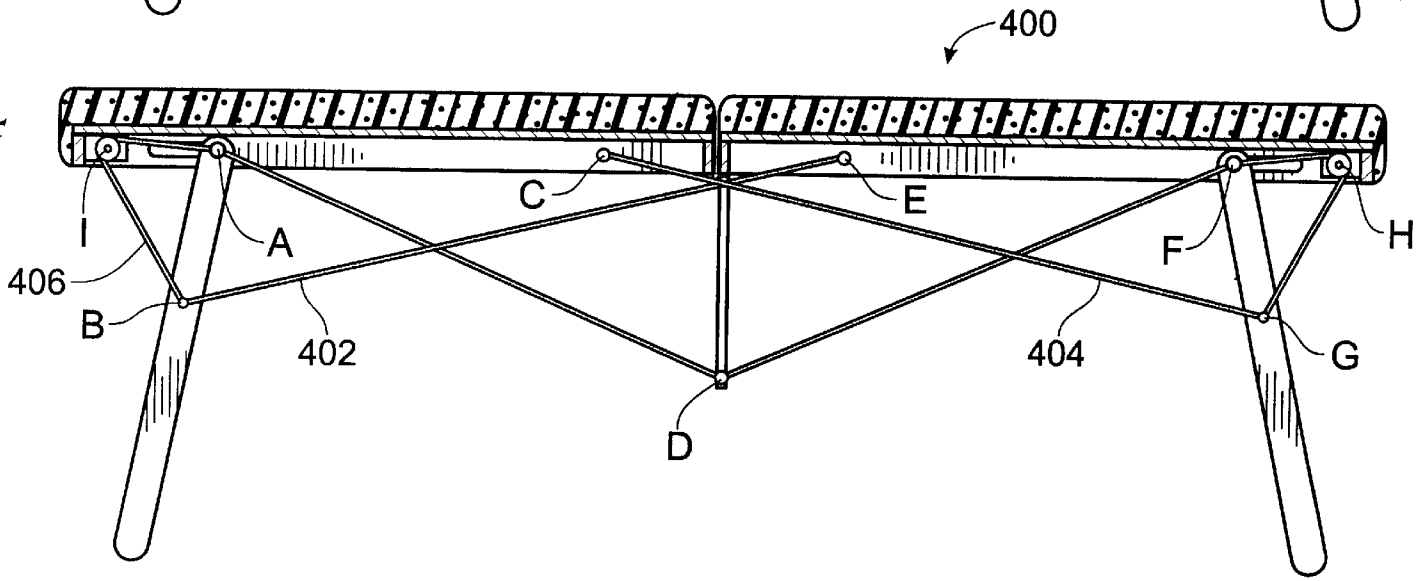

FIG. 14 shows table 400 which is similar in most respects to table 380 of FIG. 13, except that table 400 employs a modified cable configuration. A first cable 402 runs from point B to point E. A second cable runs from point G to point C. It is important for the first and second cables to be securely and firmly attached at points B, E, C and G because these cables counteract significant forces which urge legs 382 and 384 outward when the table is loaded. A third cable runs from point B, around a pulley at point L to point A to point D to point F, around another pulley at point H, and finally to point G. While it is preferred to use pulleys at points I and H, other types of slidable connection mechanisms can be used to allow cable 406 to slide, i.e., move around and relative to points I and H. The cable configuration shown in FIG. 14 allows table 400 to be folded up more easily then table 380 of FIG. 13, and also improves the table's stability by putting more tension on cable 406.

Figure 15:
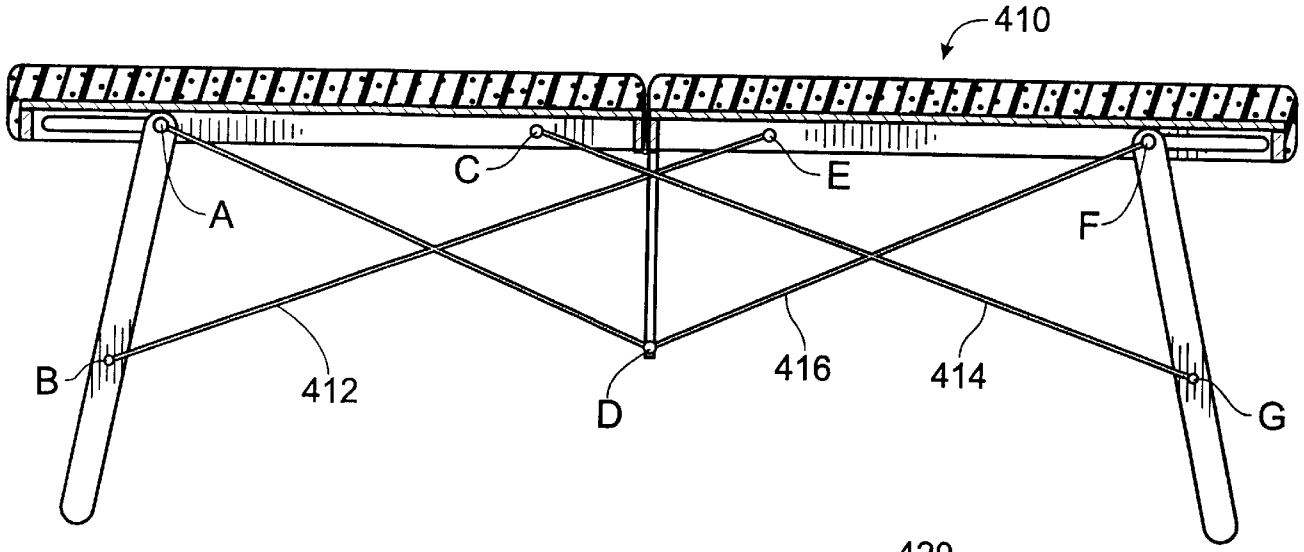
Figure 16:
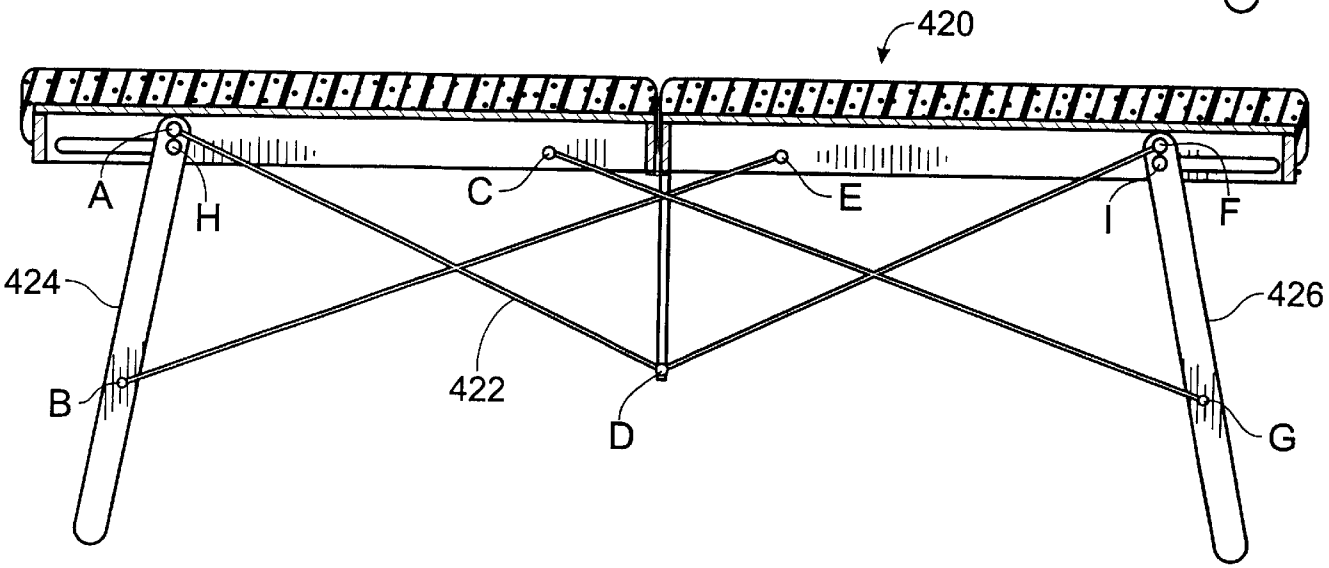

FIG. 15 shows table 410 which is similar to tables 380 and 400, except a simplified cable configuration is used. In contrast to tables 380 and 400 of FIGS. 13 and 14, table 410 does not include cables connecting the legs to their respective table ends. Another distinction of table 410 is that the points (B and G) of cable attachment are lower on the legs, thereby providing improved support and stability. A first cable 412 runs from point B to point E. A second cable runs from point G to point C. A third cable runs from point A to point D to point F. Table 420 of FIG. 16 is the same as table 410 except points A and F have been raised slightly above leg pivot points H and I, thus providing a small moment counteracting any tendency for the legs to rotate toward the collapsed position. Cable 422 runs from point A, above pivot point H on leg 424, to point D to point F, above pivot point I on leg 426.

FIG. 17 shows collapsible table 440 which utilizes a simplified cable configuration compared to those previously described, and external non-folding rigid diagonal braces. Similar to the tables described in FIGS. 13–16, legs 442 and 444 are connected, at their distal tips, to table top 445 through slots 446 and 448, respectively. Legs 442 and 444 also are connected to table top 445 via external diagonal braces 450 and 452, respectively. When table 440 is collapsed, the proximal tips of legs 442 and 444 move toward the opposite ends of slots 446 and 448, while braces 450 and 452 simultaneously fold up against the underside of table top 445. Braces 450 and 452 provide enhanced support, particularly when the table is loaded at one or both of its ends.

FIGS. 18–21 show further details or modifications of the design illustrated in FIG. 17. FIG. 18 shows an end of table 460 which is similar to table 440 of FIG. 17, except the slot is modified. Leg 462 is connected to table 460 via brace 464, and through slot 466. When table 460 is collapsed, the proximal end of leg 462 moves to the opposite end of slot 466. A notch 468 is provided at the inner end of slot 466 for the purpose of securing or stabilizing leg 462 in its open position.

FIG. 19 shows massage table 470 which is similar to table 440 of FIG. 17, except the legs are not moveable in slots, and a modified brace design is used. Table 470 has a table top 472 supported on one side, by legs 474 and 476. Center support truss 478 provides support in the center of the table similar to table designs previously described. Each end of table top 472 is supported by a telescoping diagonal brace 480 and 482, connecting points A to B, and C to D, respectively. When table 470 is fully open and upright, braces 480 and 482 are maximally compressed. Cable 484 runs from point B on leg 474, through telescoping brace 480, to point A to point E, at the distal tip of truss 478, to point D, through telescoping brace 482, to point C on leg 476. It is important for points A and D to be slidable so that cable 484 can move around and relative to those points, thus accommodating extension and compression of braces 480 and 482. In contrast, it is also critical that cable connection points D and C are secure non-sliding attachment points.

FIG. 20 shows a partial view of one end of table 470 with a portion of telescoping brace 482 cut away. Brace 482 has an inner member 490 which is pivotally bolted, through spacer 491, to leg 476 at point C. An outer shell member 492 of brace 482 encompasses inner member 490, and is capable of sliding relative to inner member 490 when brace 482 is extended or retracted. Outer shell member 492 is pivotally attached to the frame of table top 472 at point D. When brace 482 is fully compressed, as shown in FIG. 20, outer shell member 492 contacts spacer 491 thereby forming a rigid support between leg 476 and table top 472. Cable 484 runs from the truss (not shown) around the pulley at point D, and extends through a central aperture in inner member 490, ultimately attaching firmly to point C on leg 476.

It is apparent that many potentially advantageous modifications of table 470 are possible by incorporating design aspects from previously described tables. For example, FIG. 21 shows collapsible massage table 500 which is the same as table 470 in FIG. 19, except the legs are moveable in slots, and the cable path is modified. Slots 501*a* and 501*b* permit pivotal leg connection points A and E to move outward when the table is collapsed, thereby making it possible to use longer legs. Cable 502 runs from point C, through telescoping brace 504, to point B, to point A at the proximal end of leg 506, to point D at the distal tip of truss 508, to point E at the proximal end of leg 510, to point F, through telescoping brace 512, ultimately attaching firmly to point G on leg 510.

FIG. 22 shows another table design of the present invention. Collapsible massage table 520 has a table top portion 522 supported on one side, by a pair of legs 524 and 526. Legs 524 and 526 are pivotally connected to table top portion 522 at points A and F, respectively. When table 520 is open, leg 524 is stabilized in an orientation perpendicular to table top 522 by diagonal brace 528 which has one end pivotally connected to leg 524 at point B, and the opposite end slidably connected at point C to the frame of table top 522 through slot 529. Similarly, leg 526 is stabilized in a perpendicular orientation relative to table top 522, by diagonal brace 530 which has one end pivotally connected to leg 526 at point G, and the opposite end slidably connected to the frame of table top 522 at point E in slot 534. Cable 536 runs from point C on brace 528 around a pulley at point A on leg 524, to point D at the distal tip of truss 538, around another pulley at point F on leg 526, to point E. Table 520 offers the advantages of avoiding the need for a folding or telescoping diagonal brace while also simplifying the number of cables required compared to some of the previously described designs. The perpendicular leg orientation provides greater table strength compared to the slanted leg designs.

Many embodiments of the invention have been illustrated and described in detail. It will be appreciated, however, that many other advantageous designs may now be created by mixing or combining elements of the described tables, all in accordance with the spirit and scope of the present invention.

I claim:

1. A collapsible table comprising a table top including table pieces hingably attached to each other so that when the table is erect the table pieces are substantially co-planar and when the table is collapsed the table portions fold substantially together, wherein the table top has opposing ends, a medial region and four corners, each corner being supported by a diagonal leg when the table is erect, each leg being connected to the table via a pivotal link that rotates toward the medial region of the table top when the table is set up, and away from the medial region of the table top when the table is collapsed, and a cable circuit running between the opposing ends of the table top to secure each leg in a diagonal substantially upright position when the table is erect without any rigid support member running from the leg toward the medial region of the table tap.

2. The table of claim 1 further comprising a truss member extending below the medial region of the table top and impinging on the cable circuit when the table is erect.

3. The table of claim 1 further comprising a pulley secured under each corner of the table top, wherein the cable circuit is free to translate around the pulleys when the table is moved between open and collapsed positions.

4. The table of claim 1, wherein each link permits an end of one of the legs to move away from the medial region of the table top when the table is collapsed.

* * * * *